US006530232B1

(12) United States Patent
Kitchens

(10) Patent No.: US 6,530,232 B1
(45) Date of Patent: Mar. 11, 2003

(54) THERMOELECTRIC SLEEVE-TYPE BEVERAGE INSULATOR APPARATUS

(76) Inventor: Mark Kitchens, 1107 Bel Air, Athens, TX (US) 75751

( * ) Notice: Subject to any disclaimer, the term of this patent is extended or adjusted under 35 U.S.C. 154(b) by 0 days.

(21) Appl. No.: 10/165,294

(22) Filed: Jun. 10, 2002

(51) Int. Cl.[7] ..... F25B 21/02
(52) U.S. Cl. ..... 62/3.3; 62/3.2; 62/457.9
(58) Field of Search ..... 62/3.2, 3.3, 3.61, 62/457.3, 457.9; 165/80.1

(56) References Cited

U.S. PATENT DOCUMENTS

| | | | | | |
|---|---|---|---|---|---|
| 3,302,428 | A | * | 2/1967 | Stoner et al. | 62/457 |
| 4,889,302 | A | * | 12/1989 | Tucker | 248/146 |
| 5,042,258 | A | * | 8/1991 | Sundhar | 62/3.2 |
| 5,283,420 | A | * | 2/1994 | Montelto | 219/432 |
| 5,842,353 | A | * | 12/1998 | Kuo-Liang | 62/190 |
| 6,141,969 | A | * | 11/2000 | Launchbury et al. | 62/3.2 |
| 6,422,024 | B1 | * | 7/2002 | Foye | 62/3.2 |

* cited by examiner

*Primary Examiner*—Denise L. Esquivel
*Assistant Examiner*—Melvin Jones

(57) ABSTRACT

A thermoelectric sleeve-type beverage insulator apparatus with a printable sleeve-type insulated jacket with a rigid enclosure mean, a thermoelectric engine assembly incorporated into the sleeve-type insulated jacket, an electrical connection mean connected to the thermoelectric engine assembly and secured to the rigid enclosure mean of the sleeve-type insulated jacket, a support base with mechanical connection mean and electrical connection mean, and an electrical power transmission mean between a power source and the support base. A preferred embodiment includes the printable sleeve-type insulated jacket that is made of printable tubular foam insulating member having an open top and closed base, an inner surface and partially exposed outer surface, a longitudinal groove on the inner surface reaching from the open top to the closed base and extending to the radial middle of the closed base, where the printable tubular foam insulating member allows use of the apparatus as an advertising medium. A preferred embodiment includes the printable tubular foam insulating member radial and longitudinal inner surface dimensions are compatible with standard individual beverage containers, where overall dimensions and aesthetic look make it recognizable as a very common beverage insulating device, also known as "koozie", and where the apparatus enables cooling or heating of standard beverage containers risk-free of contamination and in-between usage cleaning.

12 Claims, 7 Drawing Sheets

THERMOELECTRIC SLEEVE-TYPE BEVERAGE INSULATOR APPARATUS

BACKGROUND OF THE INVENTION

This invention relates generally to the field of thermoelectric coolers, and more particularly to thermoelectric sleeve-type beverage insulator apparatus.

Early 19th Century Jean Peltier first discovered the phenomena that is the basis of today's thermoelectric industry. Peltier learned that passing current through two dissimilar electrical conductors, caused heat to be either emitted or absorbed at the junction of the materials. It was only after mid-20th Century advancements in semiconductor technology, however, that practical applications for thermoelectric devices became feasible. With modern techniques, thermoelectric modules deliver efficient solid state heat pumping for both cooling and heating. There are an increasing number and variety of products which use thermoelectric technology. Applications range from picnic boxes, small refrigerators, and water coolers, to laser applications and highly specialized instrumentation and testing equipment.

Thermoelectric refrigerating or heating appliances are known to exist. Examples of such appliances include U.S. Pat. No. 5,927,078 to Watanabe; U.S. Pat. No. 4,107,934 to Beitner; U.S. Pat. No. 6,003,318 to Busick; U.S. Pat. No. 5,042,258 to Sundhar. All of the above disclose actual refrigeration units whose purpose is to store and cool food or liquid products. U.S. Pat. No. 5,669,538 to Ward discloses a sleeve-type beverage insulator whose insulating medium is similar to the present invention.

None of the above patents, to the exception of Ward's prior art, discloses the use of an apparatus for individual beverage container. While Ward's disclosure does include the use of an individual sleeve-type beverage insulator, it does not offer the mean to cool or heat the enclosed beverage. As for Sundhar prior art, it does offer cooling mean for individual beverage consumption but requires discarding of the original beverage container thus creating possible contamination of the product to be consumed, and requires cleaning of the disclosed invention between use. Although some of the thermoelectric prior art can be deemed portable, none are small enough and physically designed to be stable and safe to use in an automotive applications and as well in static applications due to their cumbersome design or unstable configuration. In addition, and this is true in general to all consumer-type thermoelectric units, thermoelectric devices often do not resembled commonly known appliances, making them difficult to market and creating compatibility issues with for example, common automotive or office space configuration.

It is thus apparent that the need exists for an improved apparatus for storing and cooling or heating individual size beverage container that fits and is stable into automotive applications, yet small enough to fit anywhere at the office or home, and is widely recognizable by the general public as a common appliance.

SUMMARY OF THE INVENTION

The primary object of the invention is to provide a sleeve-type beverage insulator with the mean to insulate, or thermoelectrically cool or heat a standard individual beverage container for maximum compatibility with marketed beverage products.

Another object of the invention is to provide a thermoelectric sleeve-type beverage insulator that does not require discarding of the original beverage container to heat or cool the enclosed liquid eliminating contamination concern or cleaning need between usage.

Another object of the invention is to provide a thermoelectric sleeve-type beverage insulator small and portable enough to be hand-held for maximum flexibility of use.

A further object of the invention is to provide a thermoelectric sleeve-type beverage insulator mechanically stable and of safe non-critical construction for automotive, household, or office applications in consumer or commercial environments.

Yet another object of the invention is to provide a thermoelectric sleeve-type beverage insulator that can operate with low voltage direct current power source or alternative current power source for maximum compatibility with commonly available electrical sources.

Still yet another object of the invention is to provide a thermoelectric sleeve-type beverage insulator expertly combining low-cost components and manufacturing techniques for universal affordability.

Another object of the invention is to provide a thermoelectric sleeve-type beverage insulator that is safe, reliable, easy to use, and environment friendly.

Another object of the invention is to provide a thermoelectric sleeve-type beverage insulator with an inexpensive printable surface for advertising and marketing purpose.

A further object of the invention is to provide a thermoelectric sleeve-type beverage insulator with very low power consumption for reduced cost of operation, improved reliability, and long autonomous operation.

Yet another object of the invention is to provide a thermoelectric sleeve-type beverage insulator designed so that its ergonomics and aesthetic look make it recognizable as a very common device, widely known to the general public, but featuring significant improvement to facilitate its successful commercialization.

Other objects and advantages of the present invention will become apparent from the following descriptions, taken in connection with the accompanying drawings, wherein, by way of illustration and example, an embodiment of the present invention is disclosed.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
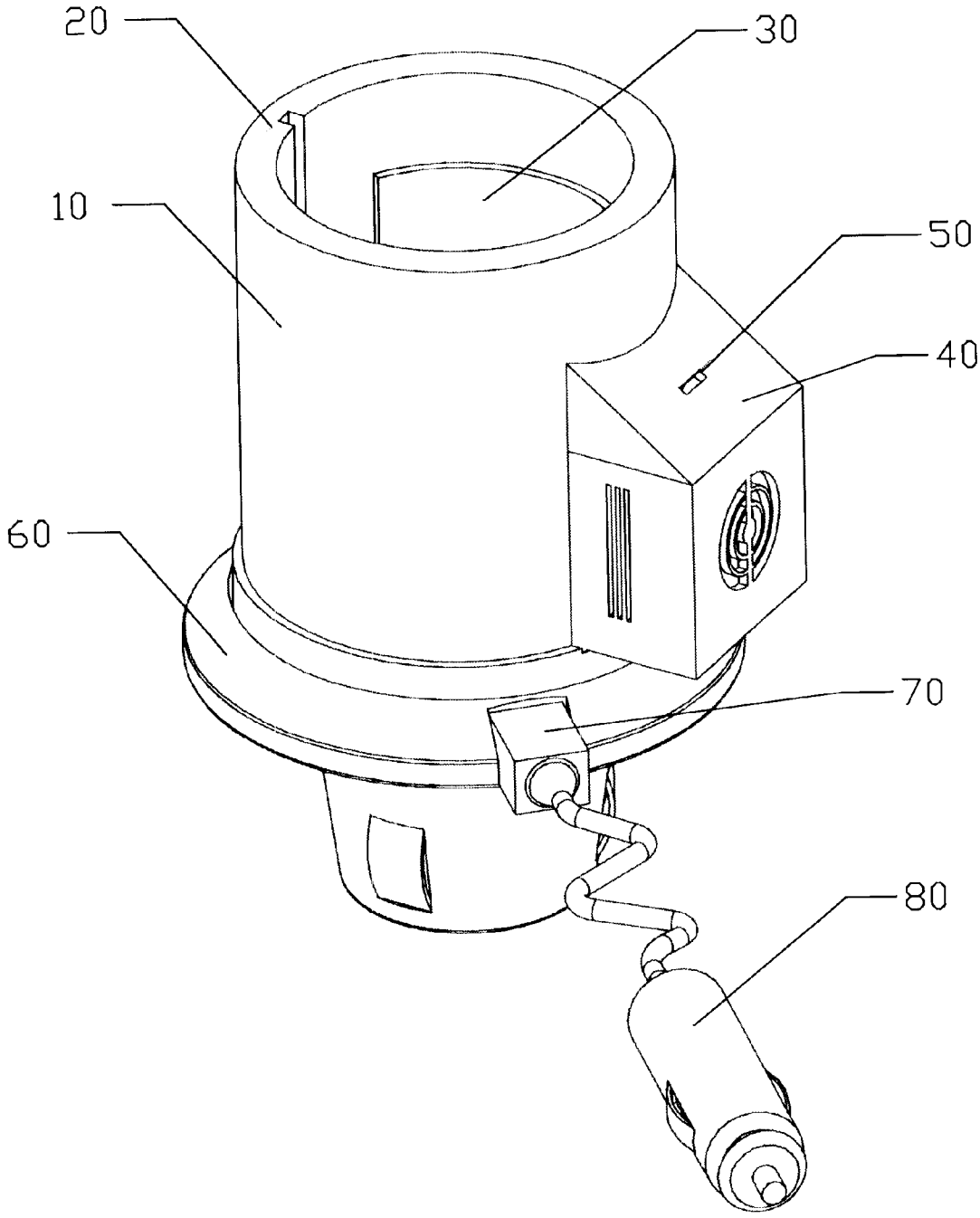
FIG. 1 is a perspective view of the invention in its automotive configuration.

Turning first to FIG. 1 there is shown a preferred embodiment of the invention in its automotive configuration. The invention consists of a sleeve-type insulating jacket 10 made of foam-like material with very low thermal conductivity having an open top and closed base, an inner surface and partially exposed outer surface. In accordance with a major aspect of the invention, the shape and material of the sleeve-type insulating jacket 10 is designed so that it is similar to the widely commercialized sleeve-type insulators known more commonly to the general public as "koozie". In a preferred embodiment, the sleeve-type insulating jacket 10 features prints on its outer surface, visible to the user.

Sleeve-type insulators known as "koozie" can perform the function of passively slowing the temperature equilibrium shift between a beverage inserted into the koozie and the surrounding ambient temperature. It is a major aspect of the invention to actively maintain or increase the temperature shift between a beverage inserted into the sleeve-type insulating jacket 10 and the surrounding ambient temperature whether this function involves positive or negative temperature shift. Thus, in the present embodiment, the invention features a mean of cooling or heating the inner surface of the sleeve-type insulation jacket 10.

In the present embodiment, the preferred cooling or heating mean is achieved using a thermoelectric heat pump. The thermoelectric heat pump consists of a compatible-shaped metal plate 30 as shown in FIG. 1, of cylindrical shape so that it fits against the inner surface of the sleeve-type insulating jacket 10 and covers a section of the sleeve-type insulating jacket 10. In turn, the compatible-shaped metal plate 30 is cooled or heated by a thermoelectric chip itself pressure fitted between said compatible-shaped metal plate 30 and a finned metal block, and where the finned metal block is ventilated by a fan. Only the compatible-shape metal plate 30 is represented in the present embodiment of the invention as it is not the object of this description to explain in detail the functioning of thermoelectric heat pumps as they are not a novelty and their technology is widely understood.

In accordance with another object of the invention, the sleeve-type insulating jacket 10 features a longitudinal groove 20 on its inner surface reaching from the open top to the closed base and extending to the radial middle of the closed base. The longitudinal groove 20 facilitates insertion or removal of a beverage container from the sleeve-type insulating jacket 10 by allowing air the move in and out of the cavity.

Figure 5:
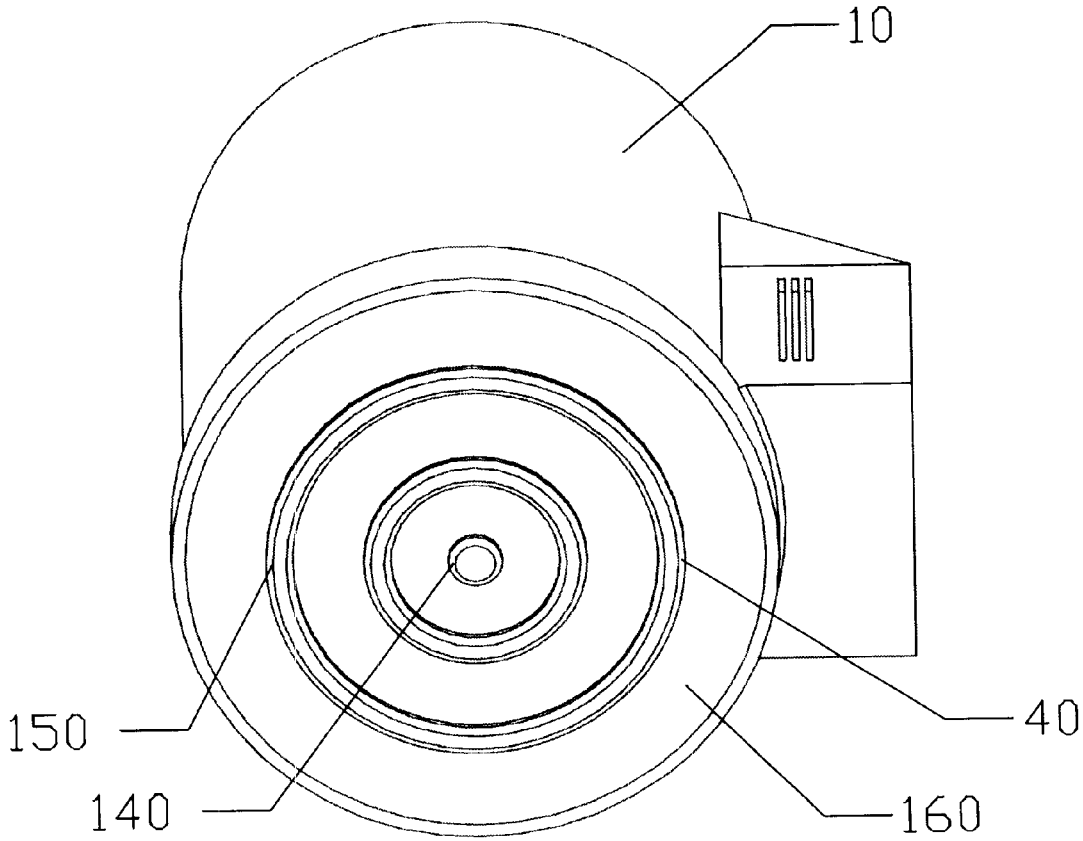
FIG. 5 is another perspective view of the invention with support base removed.

In accordance with a major aspect of a preferred embodiment of the present invention, there is also shown in FIG. 1 the rigid enclosure mean 40. Rigid enclosure mean 40 can consists of hard polymeric material or metallic material or combination thereof. Rigid enclosure mean 40 houses the thermoelectric chip, finned metal block and fan of the thermoelectric heat pump. Rigid enclosure mean 40 also houses the light-emitting device 50 that indicates operational status. The light-emitting device 50 is on whenever the invention is powered up. Also, as another aspect of the present invention, rigid enclosure mean 40 is secured to the bottom section of the sleeve-type insulating jacket 10. Turning now to FIG. 5, there is shown a perspective view of the sleeve-type insulating jacket 10/rigid enclosure mean 40 assembly, viewed from the underside. In accordance with an object of the invention, rigid enclosure 40 houses electrical connection mean between the thermoelectric heat pump and positive contact 140 and negative contact 150. In this preferred embodiment, positive contact 140 and negative contact 150 are made of metallic electrically conductive material having a flat exposed surface for easy electrical conductivity on contact as described subsequently. In this preferred embodiment, rigid enclosure mean 40 also houses mechanical connection mean 160. In this particular embodiment, mechanical connection mean 160 consists of a metallic material responsive to magnetic fields and having a flat exposed surface for facilitating magnetic bond on contact as described subsequently.

Figure 3:
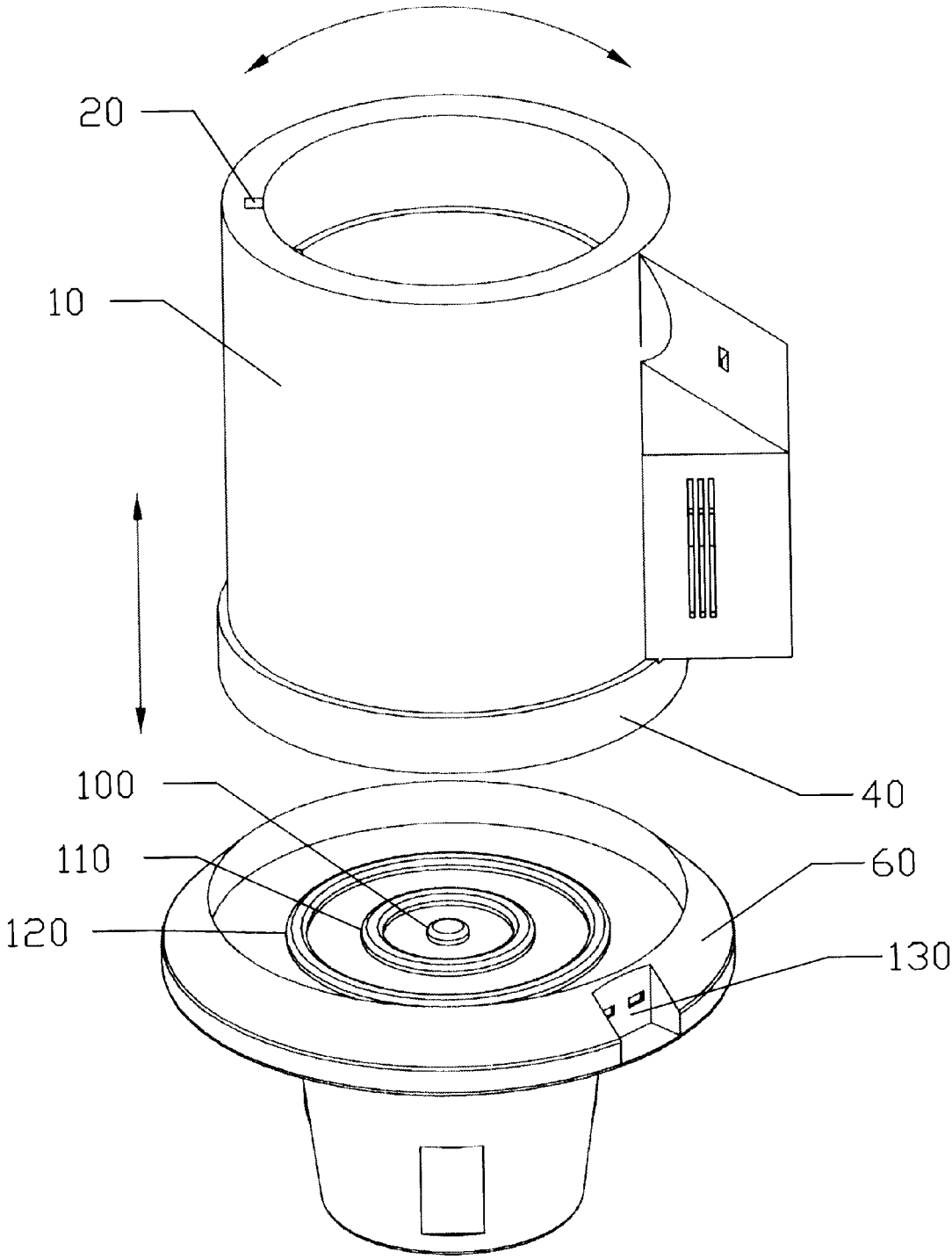
FIG. 3 is a perspective view of the invention with automotive support base disengaged.

Turning back to FIG. 1, and in accordance with a major object of this invention, there is shown the apparatus in its automotive configuration. Support base 60 preferred embodiment consists of hard polymeric material or metallic material or combination thereof and where its shape facilitates mechanically stable and safe use in automotive application. In other words, the support base 60 can be installed in a vehicle cup holder. Turning now to FIG. 3, there is shown a perspective view of the invention in its automotive configuration. In this view, support base 60 is disengaged from rigid enclosure mean 40. Support base 60 can engage or disengaged with rigid enclosure mean 40 repeatedly as shown by the vertical motion arrows and at any radial angle as shown by the planar motion arrows. When engaged, positive contact 100 establishes electrical contact with positive contact 140 and negative contact 110 established electrical contact with negative contact 150. To retain rigid enclosure 40 engaged with support base 60, magnetic ring 120 attracts mechanical connection mean 160. Therefore, in accordance with a major aspect of this invention, when the user engages the rigid enclosure mean 40 with support base 60, the invention is powered up and the beverage container is actively cooled or heated, the assembly being safely and easily retained engaged via the uses of magnetic ring 120. When the uses wishes to drink the content of the beverage container he simply picks up the sleeve-type insulating jacket 10, in effect disengaging support base 60 from rigid enclosure mean 40, the thermoelectric heat pump is no longer powered up but the sleeve-type insulating jacket insulates the beverage container. Do to the circular shape of the support base and the use of a magnetic-type securing mean, the operation of engaging or disengaging the rigid enclosure mean 40 with the support base 60 can be achieved at any radial angle and without actual visual sighting of the invention which greatly facilitates safe use of the invention in an automotive application.

Turning back to FIG. 1, there is shown electrical power transmission mean 70, electrical power transmission mean 70 consist of a reversible electrical plug that connects with plug receptacle 130 shown on FIG. 3. Depending on the polarity (orientation) of the connection between the electrical power transmission mean 70 and plug receptacle 130, the invention will operate in cooling or heating mode. Electrical power transmission mean 70 also connects with automotive plug 80. In this preferred embodiment, automotive plug 80 permits the invention to operate using a direct current power source and houses electrical safety mean such as a current-limiting device in case of malfunction of the invention.

Figure 2:
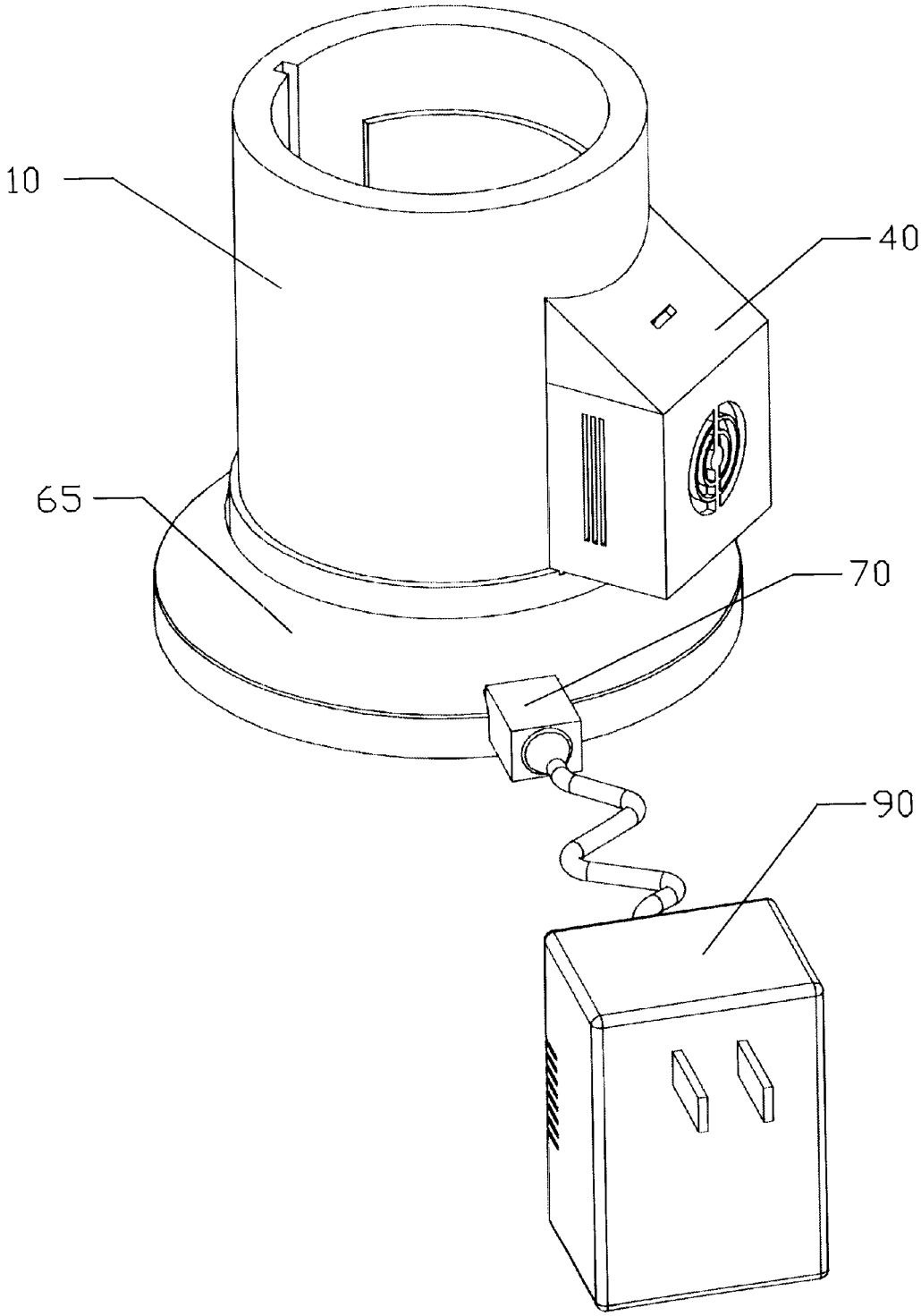
FIG. 2 is a perspective view of the invention in its desktop configuration.
Figure 4:
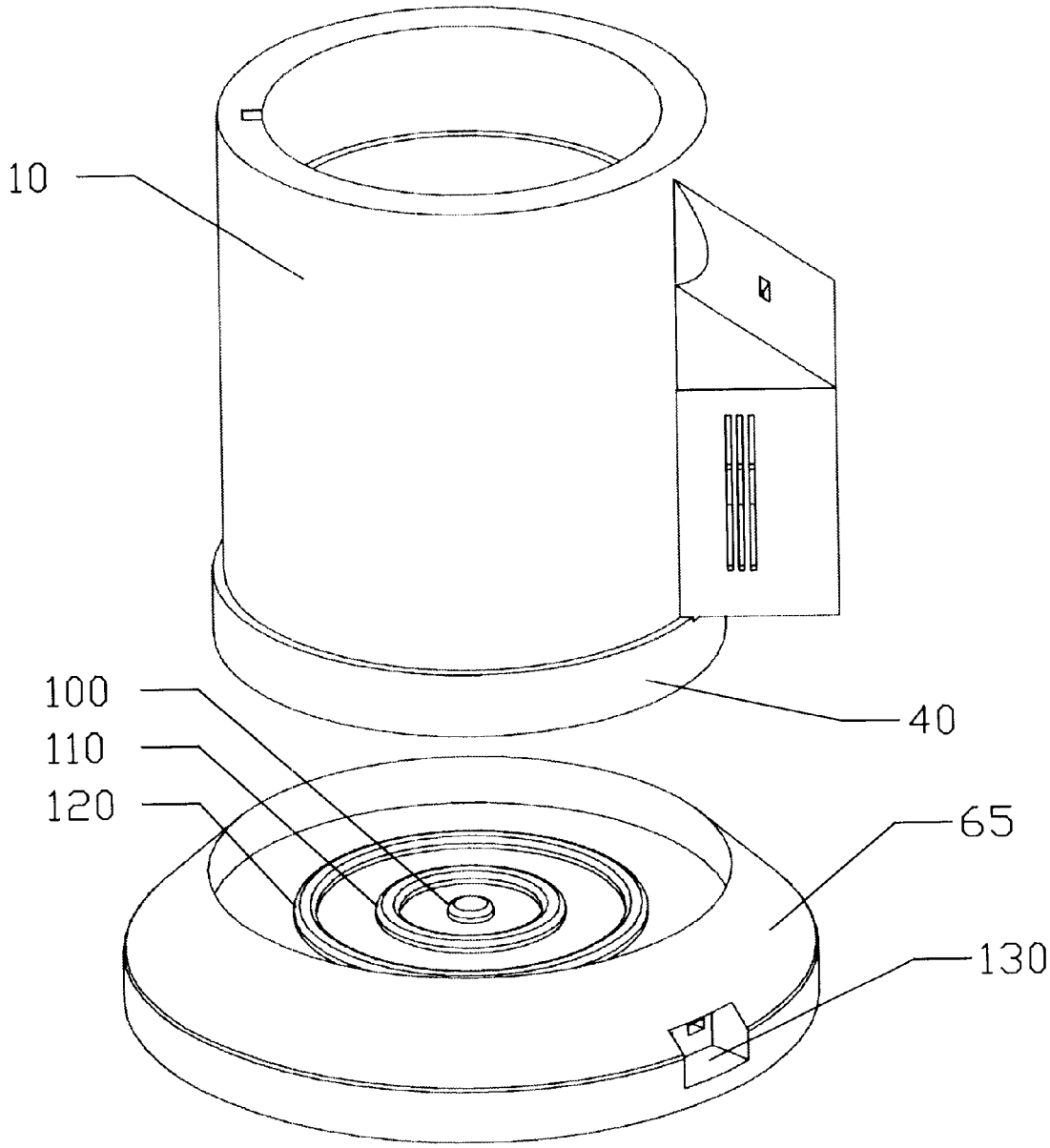
FIG. 4 is a perspective view of the invention with desktop support base disengaged.

Turning now to FIG. 2, there is shown a preferred embodiment of the same invention in its desktop configuration. Sleeve-type insulating jacket 10 along with rigid enclosure mean 40 and housed components remain unchanged from the automotive configuration. However support base 60 is replaced by support base 65. Support base 65 is made of hard polymeric material or metallic material or combination thereof and its shape permits stable and safe use as a desktop application at home or office in a consumer or commercial environment. As shown in FIG. 4, support base 65 houses the same positive contact 100, negative contact 110 and magnetic ring 120 as support base 60. Operation of the invention remains the same whether in automotive or desktop configuration. Support base 65 also uses same receptacle plug 130. However, in this preferred embodiment of the desktop configuration, Electrical power transmission mean 70 connects with power conversion mean 90 to allow the invention to operate using an alternative current power source. Power conversion mean 90 can consist of an electrical transformer to convert alternative current power source into a power source compatible with thermoelectric heat pump energy requirements and houses electrical safety mean such as a current-limiting device.

Figure 6A:
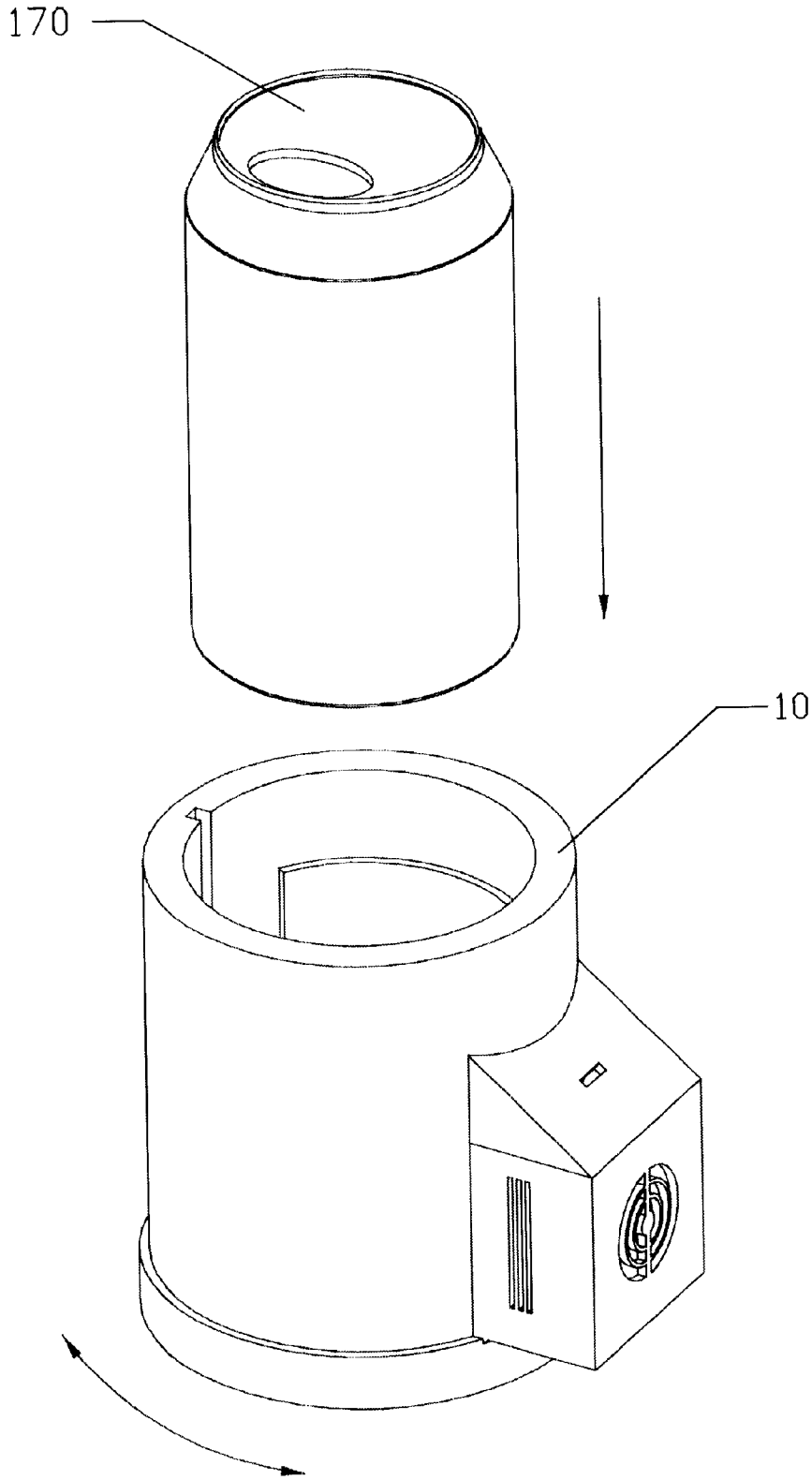
FIG. 6A is another perspective view of the invention with a standard beverage container.
Figure 6B:
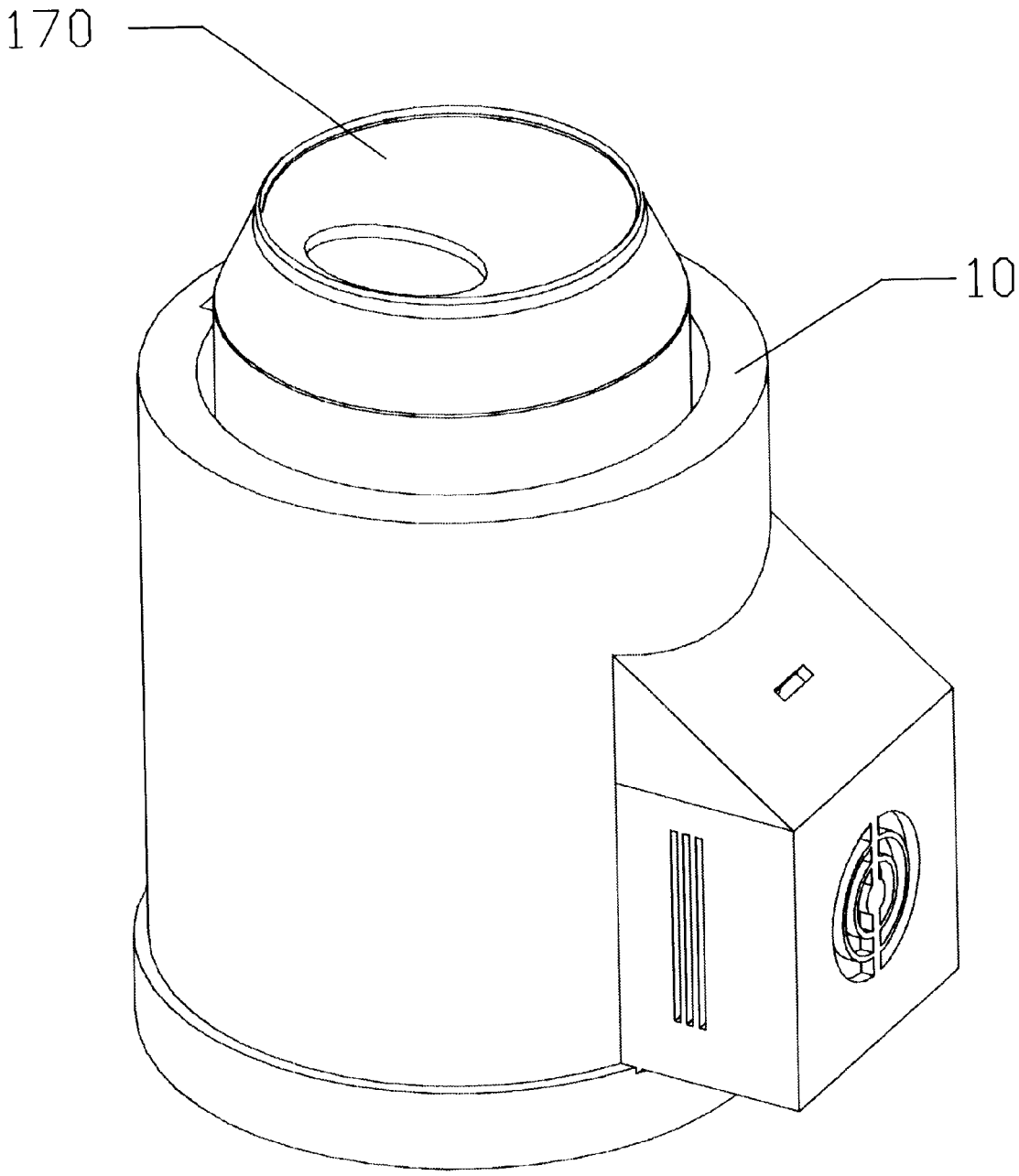
FIG. 6B is another perspective view of the invention with a standard beverage container installed.

Finally, turning now to FIG. 6A, and to better illustrate the use of the present invention, there is shown the operation (see motion arrows) of inserting a standard beverage container 170 into the sleeve-type insulating jacket 10, the result of such operation is shown on FIG. 6B.

The invention allows active cooling or heating of a standard beverage container presenting several advantages over the existing prior art. Commonly know sleeve-type insulating device (Koozie) only offer insulating mean but no active operation. Other thermoelectrically powered prior art have the disadvantage of being custom units that do not easily and safely fit in automotive or other applications, are not widely known to the public rendering their successful commercialization difficult. The invention's small thermoelectric heat pump permits low power consumption, insures low cost of operation, and extended autonomous operation. The use of low-cost components and manufacturing techniques allows for universal affordability. The technology utilized permits the invention to be reliable, easy to use, and environment friendly. Through various embodiments, the invention can also include a switch to control operational status, a mean for temperature controlling and/or monitoring, and use replenishable or renewable energy source. And of course, the main advantage of using a printable sleeve-type insulating jacket is that the invention can be used as an advertising medium, and beverage containers can be cooled or heated risk-free of contamination and in-between usage cleaning.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A thermoelectric sleeve-type beverage insulator apparatus comprising:

a printable sleeve-type insulated jacket with a rigid enclosure mean;

a thermoelectric engine assembly incorporated into the sleeve-type insulated jacket;

an electrical connection mean connected to the thermoelectric engine assembly and secured to the rigid enclosure mean of the sleeve-type insulated jacket;

a support base with mechanical connection mean and electrical connection mean; and an electrical power transmission mean between a power source and the support base.

2. A thermoelectric sleeve-type beverage insulator apparatus as claimed in claim 1 wherein said printable sleeve-type insulated jacket is made of printable tubular foam insulating member having an open top and closed base, an inner surface and partially exposed outer surface, a longitudinal groove on the inner surface reaching from the open top to the closed base and extending to the radial middle of the closed base; where the printable tubular foam insulating member allows use of the said apparatus as an advertising medium.

3. A thermoelectric sleeve-type beverage insulator apparatus as claimed in claim 2 wherein said printable tubular foam insulating member radial and longitudinal inner surface dimensions are compatible with standard individual beverage containers; where overall dimensions and aesthetic look make it recognizable as a very common beverage insulating device; and where said apparatus enables cooling or heating of standard beverage containers risk-free of contamination and in-between usage cleaning.

4. A thermoelectric sleeve-type beverage insulator apparatus as claimed in claim 1 wherein said thermoelectric engine assembly cools or heats the inner surface of the printable tubular foam insulating member utilizing a compatible-shaped metal plate covering a section of said inner surface; where said compatible-shaped metal plate is cooled or heated by a thermoelectric chip itself pressure fitted between said compatible-shaped metal plate and a finned metal block; where said finned metal block is ventilated by a fan; where the combination of compatible-shaped metal plate, thermoelectric chip, finned metal block, and fan is said thermoelectric engine assembly; and where said thermoelectric engine assembly having a low power consumption insures low cost of operation, reliability, and extended autonomous operation.

5. A thermoelectric sleeve-type beverage insulator apparatus as claimed in claim 1 wherein said rigid enclosure mean houses said thermoelectric engine assembly protruding from said outer surface of said sleeve-type insulated jacket and houses a section of said sleeve-type insulated jacket; where said rigid enclosure mean is made of hard polymeric material or metallic material or combination thereof and features mechanical mean to secure or unsecure said rigid enclosure mean to said support base mechanical connection mean at any radial angle and where the operation of securing or unsecuring can be achieve without visual sighting of said apparatus.

6. A thermoelectric sleeve-type beverage insulator apparatus as claimed in claim 1 wherein said electrical connection mean secured to said rigid enclosure mean contacts said support base electrical connection mean when said rigid enclosure mean is secured to said support base.

7. A thermoelectric sleeve-type beverage insulator apparatus as claimed in claim 1 wherein said support base embodiment is made of hard polymeric material or metallic material or combination thereof; where said support base facilitates mechanically stable and safe use for automotive, household, or office applications in consumer or commercial environments.

8. A thermoelectric sleeve-type beverage insulator apparatus as claimed in claim 1 wherein said electrical power transmission mean enables said thermoelectric sleeve-type beverage insulator apparatus to operate using direct current power source or alternative current power source or combination thereof.

9. A thermoelectric sleeve-type beverage insulator apparatus as claimed in claim 1 wherein said apparatus facilitates hand-held operation, combines low-cost components and manufacturing techniques for universal affordability; where said apparatus is reliable, easy to use, and environment friendly.

10. A thermoelectric sleeve-type beverage insulator apparatus as claimed in claim 1 wherein said apparatus further comprises a light-emitting device indicative of operational status; where said apparatus further comprises a switch for control of operational status; and where said apparatus further comprises temperature monitoring and, or temperature controlling mean.

11. A thermoelectric sleeve-type beverage insulator apparatus as claimed in claim 8 further comprising electrical source power converting mean and electrical safety mean; where said electrical power transmission mean permits cooling or heating operational modes of said apparatus.

12. A thermoelectric sleeve-type beverage insulator apparatus as claimed in claim 7 wherein said support base further utilizes replenishable and renewable electrical energy source.

* * * * *